US011130345B2

(12) United States Patent
Murayama

(10) Patent No.: US 11,130,345 B2
(45) Date of Patent: Sep. 28, 2021

(54) LIQUID EJECTING HEAD AND LIQUID EJECTING SYSTEM

(71) Applicant: SEIKO EPSON CORPORATION, Tokyo (JP)

(72) Inventor: Toshiro Murayama, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/872,509

(22) Filed: May 12, 2020

(65) Prior Publication Data

US 2020/0361219 A1 Nov. 19, 2020

(30) Foreign Application Priority Data

May 14, 2019 (JP) ..... JP2019-091187

(51) Int. Cl.

| | |
|---|---|
| ***B41J 2/175*** | (2006.01) |
| ***B41J 2/18*** | (2006.01) |
| ***B41J 2/14*** | (2006.01) |
| ***B41J 2/19*** | (2006.01) |

(52) U.S. Cl.

CPC ..... *B41J 2/175* (2013.01); *B41J 2/17563* (2013.01); *B41J 2/18* (2013.01); *B41J 2/19* (2013.01); *B41J 2002/14403* (2013.01); *B41J 2002/14419* (2013.01)

(58) Field of Classification Search

CPC . B41J 2/17563; B41J 2/19; B41J 2/175; B41J 2/18; B41J 2002/14403; B41J 2002/14419

See application file for complete search history.

(56) References Cited

U.S. PATENT DOCUMENTS 7,380,927 B2 * 6/2008 Shigemura ..... B41J 2/1408 347/65

2002/0196316 A1 12/2002 Nakamura

FOREIGN PATENT DOCUMENTS

JP 2003-080731 A 3/2003

* cited by examiner

*Primary Examiner* — Geoffrey S Mruk

(74) *Attorney, Agent, or Firm* — Workman Nydegger

(57) ABSTRACT

A liquid ejecting head has a supply opening toward which a liquid is supplied, a collection opening through which the supplied liquid is collected, a nozzle that ejects the liquid supplied from the supply opening, and a filter disposed at an intermediate point in a flow path that couples the supply opening and the nozzle together. The liquid ejecting head further has a plurality of outlets leading from an upstream chamber disposed upstream of the filter to the collection opening.

18 Claims, 12 Drawing Sheets

LIQUID EJECTING HEAD AND LIQUID EJECTING SYSTEM

The present application is based on, and claims priority from JP Application Serial Number 2019-091187, filed May 14, 2019, the disclosure of which is hereby incorporated by reference herein in its entirety.

BACKGROUND

1. Technical Field

The present disclosure relates to a liquid ejecting head and liquid ejecting system that eject a liquid, and more particularly to an ink jet recording head and ink jet recording system that eject ink as a liquid.

2. Related Art

An ink jet recording head that discharges ink as a liquid is a typical example of a liquid ejecting head. A filter that captures dust and bubbles included in ink is provided in a flow path in the ink jet recording head.

When the filter is clogged with foreign matter, the effective area of the filter is reduced. In view of this, in a proposal made in, for example, JP-A-2003-80731, a bypass is provided that couples an ink collection opening and an upstream chamber disposed upstream of a filter together so that bubbles in the upstream chamber are expelled to the ink collection opening through the bypass.

However, there is a need for a further improvement in the ease with which bubbles are expelled from the upstream chamber disposed upstream of the filter.

SUMMARY

The present disclosure addresses the above problem with the object of providing a liquid ejecting head and liquid ejecting system in which an improvement is made in the ease with which bubbles are expelled from an upstream chamber disposed upstream of a filter.

An aspect of the present disclosure that addresses the above problem is a liquid ejecting head that has a supply opening toward which a liquid is supplied, a collection opening through which the liquid supplied from the supply opening is collected, a nozzle that ejects the liquid supplied from the supply opening, and a filter disposed at an intermediate point in a flow path that couples the supply opening and the nozzle together. The liquid ejecting head further has a plurality of outlets leading from an upstream chamber disposed upstream of the filter to the collection opening.

Another aspect of the present disclosure is a liquid ejecting system that has the liquid ejecting head described above and a mechanism that supplies a liquid toward the supply opening and collects the liquid through the collection opening to circulate the liquid.

DESCRIPTION OF EXEMPLARY EMBODIMENTS

Figure 1:
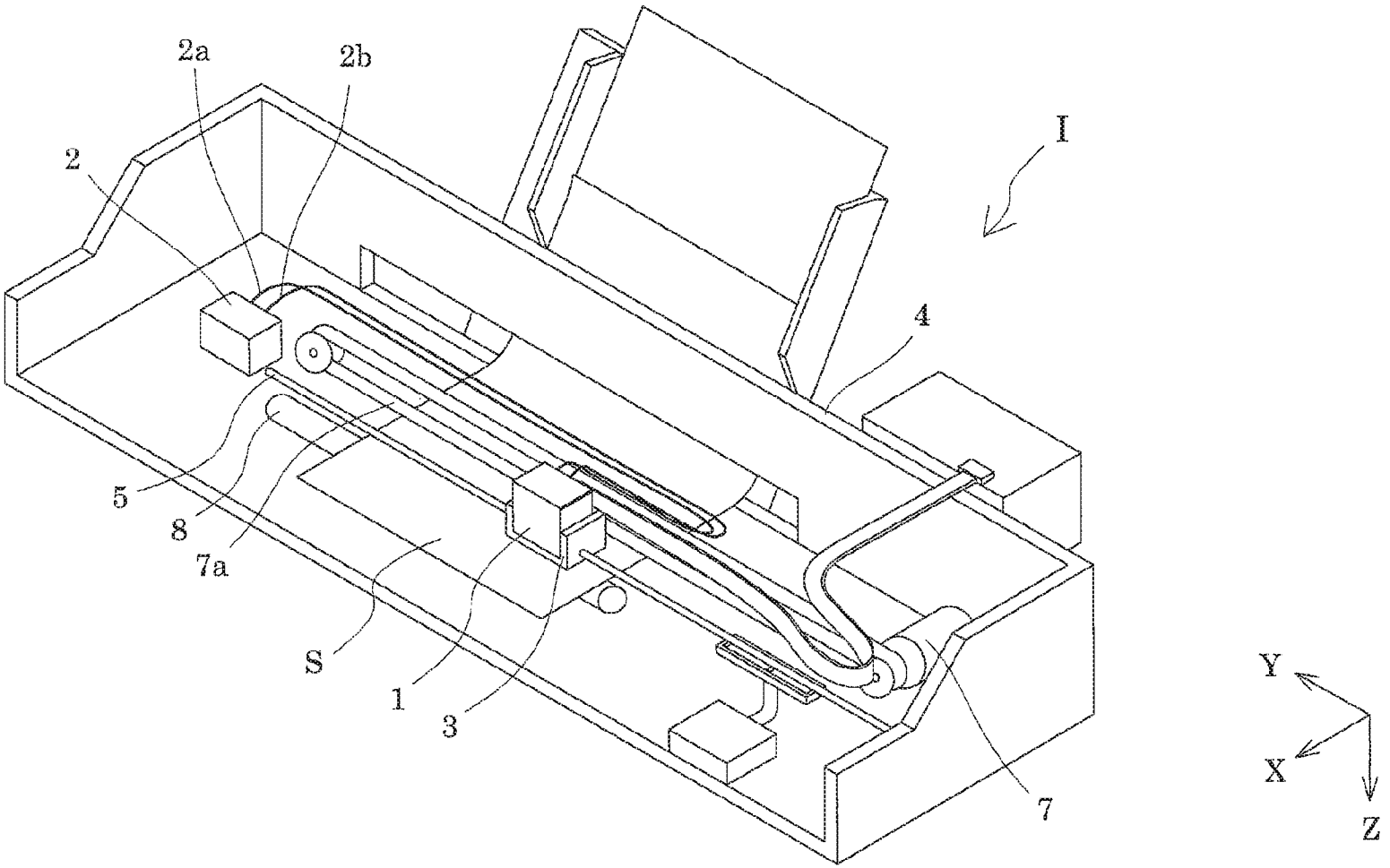
FIG. 1 schematically illustrates a recording apparatus according to a first embodiment of the present disclosure.

The present disclosure will be described below according to embodiments. However, the description below indicates only an aspect of the present disclosure and can thereby be arbitrarily modified. Like members in the drawings are indicated by like reference characters, and the description of these members will be appropriately omitted. X, Y, and Z in drawings represent three spatial axes that are mutually orthogonal. In this specification, directions along these axes will be referred to as the X direction, Y direction, and Z direction. In the description below, the direction indicated by the orientation of an arrow in drawings will be taken as the positive (+) direction and a direction opposite to the orientation of the arrow will be taken as the negative (−) direction. The Z direction is the vertical direction. The + Z direction is the upward vertical direction and the − Z direction is the downward vertical direction.

First Embodiment

An example of an ink jet recording apparatus, which is an example of a liquid ejecting apparatus in the present disclosure, will be described with reference to FIG. 1. FIG. 1 schematically illustrates the structure of the ink jet recording apparatus.

In the ink jet recording apparatus I, which is an example of a liquid ejecting apparatus, an ink jet recording head 1 (also referred to blow simply as the recording head 1), which is an example of a plurality of liquid ejecting heads, is mounted on a carriage 3, as illustrated in FIG. 1. The carriage 3, on which the recording head 1 is mounted, is provided so as to be movable along the axial direction of a carriage shaft 5 attached to a main body 4. In this embodiment, the direction along which the carriage 3 moves is the Y direction.

A tank 2, which is a holder in which ink is held as a liquid, is provided in the main body 4. The tank 2 is coupled to the recording head 1 through a first supply tube 2*a* such as a flexible tube. Ink in the tank 2 is supplied to the recording head 1 through a first supply tube 2*a* such as a flexible tube. The recording head 1 and tank 2 are coupled together through a first collection tube 2*b* such as a flexible tube. Ink expelled from the recording head 1 is collected into the tank 2 through the first collection tube 2*b*, that is, so-called circulation is performed. A plurality of tanks 2 may be provided.

The driving force of a driving motor 7 is transmitted to the carriage 3 through a plurality of gears (not illustrated) and a timing belt 7*a*. Then, the carriage 3, on which the recording head 1 is mounted, is moved in the Y direction along the carriage shaft 5. A transport roller 8, which is a transporter, is provided in the main body 4. A recording sheet S, which is a medium such as paper onto which a liquid is ejected, is transported toward the X direction by the transport roller 8. The transporter that transports a recording sheet S is not limited to the transport roller 8. The transporter may be a belt, a drum, or the like.

In the recording apparatus I of this type, when ink droplets are ejected from the recording head 1 while a recording sheet S is being transported toward the X direction and the recording head 1 is being moved along the Y direction, the ink droplets are landed on the recording sheet S, that is, printing is performed.

Figure 2:
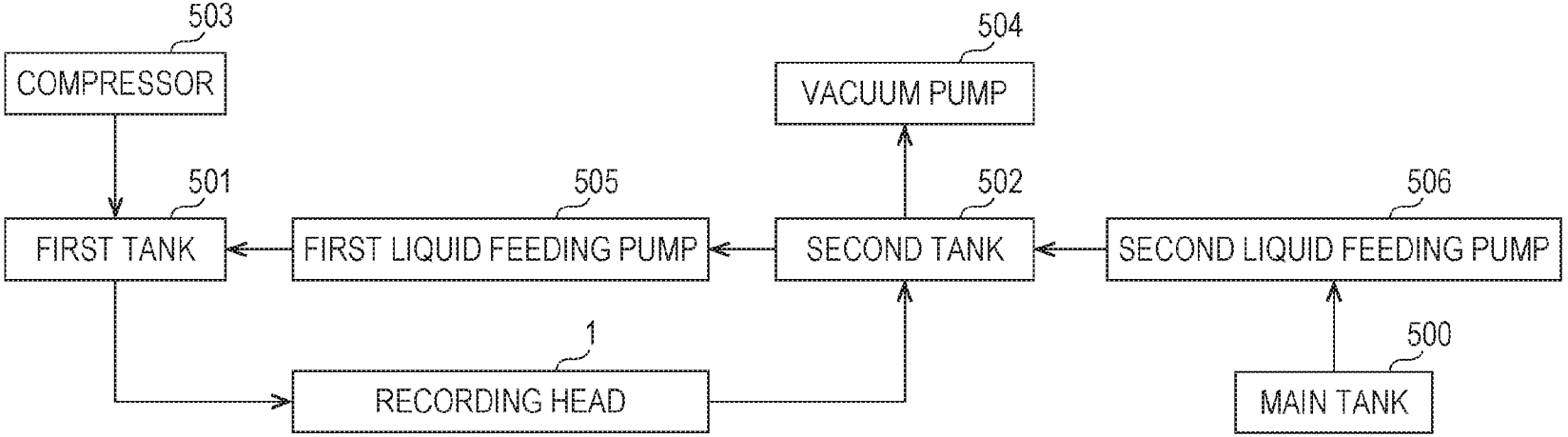
FIG. 2 is a block diagram of a recording system according to the first embodiment of the present disclosure.

Now, an example of a liquid ejecting system in this embodiment will be described with reference to FIG. 2. FIG. 2 is a block diagram of an ink jet recording system, which is the liquid ejecting system in the present disclosure.

As illustrated in FIG. 2, the ink jet recording system (also referred to below as simply the recording system), which is a liquid ejecting system, has the recording head 1, and also has a main tank 500, a first tank 501, a second tank 502, a compressor 503, and a vacuum pump 504, a first liquid feeding pump 505, and a second liquid feeding pump 506 as a mechanism that supplies ink to the recording head 1 and collects the supplied ink. In FIG. 2, the main tank 500, first tank 501, and second tank 502 constitute the tank 2 in the ink jet recording apparatus I in FIG. 1.

The recording head 1 and compressor 503 are coupled to the first tank 501. The compressor 503 supplies ink in the first tank 501 to the recording head 1 under predetermined positive pressure.

The second tank 502 is coupled to the first tank 501 with the first liquid feeding pump 505 intervening between them. The first liquid feeding pump 505 feeds ink in the second tank 502 to the first tank 501.

The recording head 1 and vacuum pump 504 are coupled to the second tank 502. The vacuum pump 504 collects ink in the recording head 1 into the second tank 502 under predetermined negative pressure.

That is, ink is supplied from the first tank 501 to the recording head 1, and the ink is collected from the recording head 1 into the second tank 502. The ink is then fed by the first liquid feeding pump 505 from the second tank 502 to the first tank 501, circulating the ink.

The main tank 500 is coupled to the second tank 502 with the second liquid feeding pump 506 intervening between them. Ink is replenished from the main tank 500 into the second tank 502 by an amount by which ink has been consumed by the recording head 1. It suffices to replenish ink from the main tank 500 into the second tank 502 at a time at which, for example, the liquid surface in the second tank 502 has dropped below a predetermined height.

Figure 3:
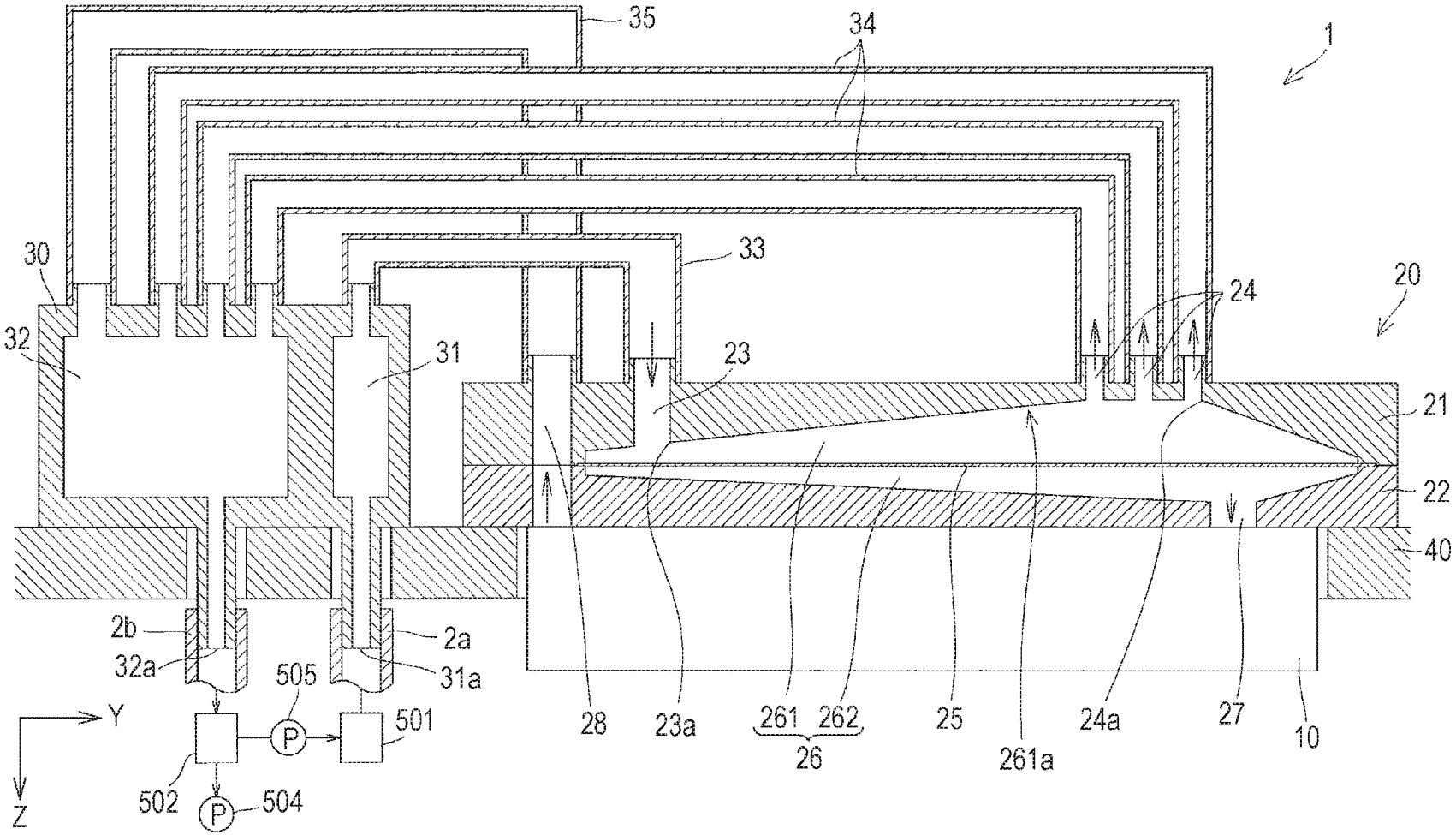
FIG. 3 is a cross-sectional view of the main elements of a recording head according to the first embodiment of the present disclosure.

Now, the ink jet recording head 1, which is an example of the liquid ejecting head in this embodiment, will be described with reference to FIG. 3. FIG. 3 is a cross-sectional view of the main elements of the ink jet recording head 1, which is an example of a liquid ejecting head.

As illustrated in FIG. 3, the recording head 1 has a head body 10 that ejects ink as a liquid, a flow path member 20 through which ink is supplied to and is collected from the head body 10, a coupling member 30 coupled to an ink supplier and an ink collector, and a holding member 40 that holds the head body 10, flow path member 20, and coupling member 30.

Figure 4:
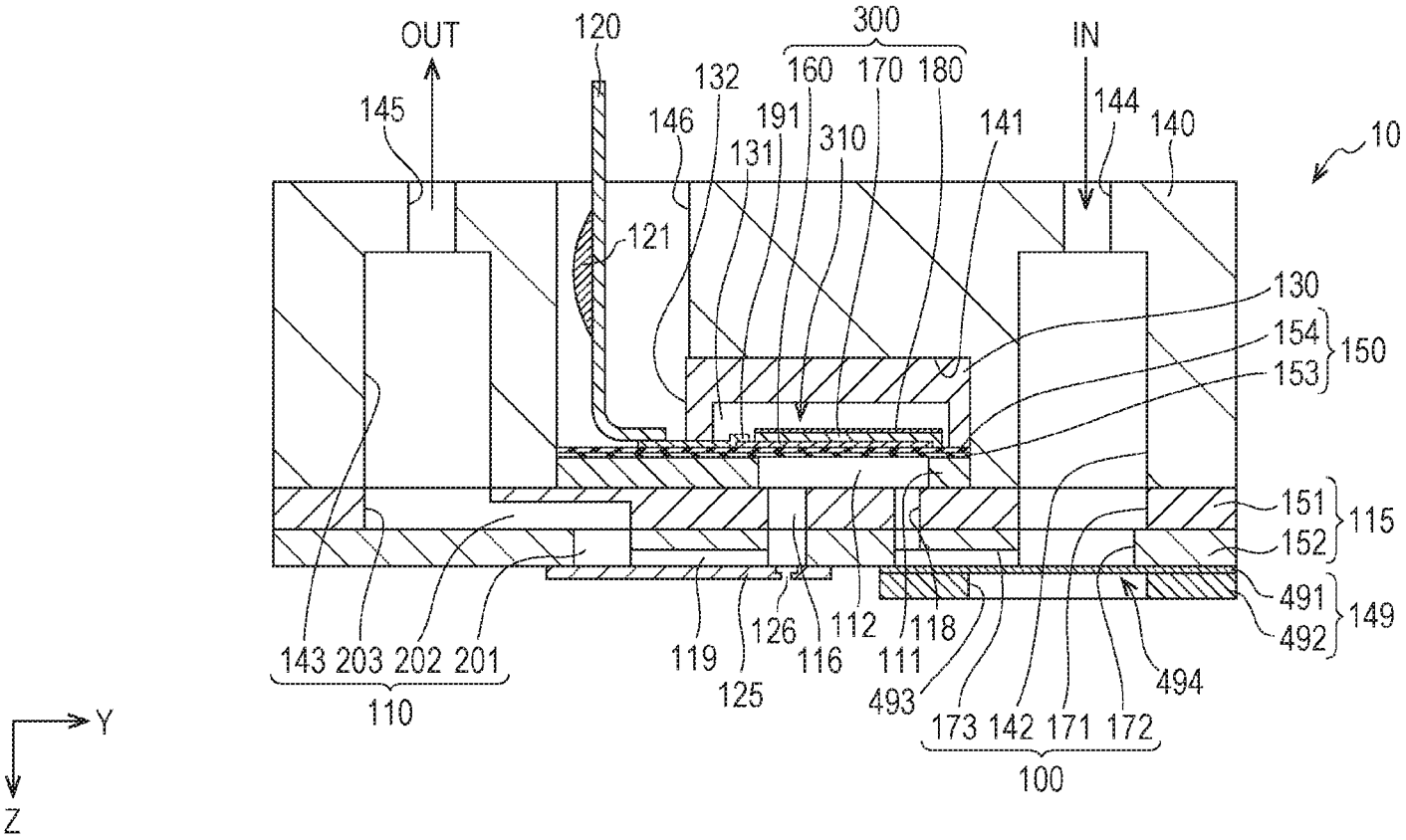
FIG. 4 is a cross-sectional view of a head body according to the first embodiment of the present disclosure.

The head body 10 will be described here with reference to FIG. 4. FIG. 4 is a cross-sectional view of the head body 10.

As illustrated in FIG. 4, a flow path forming substrate 111, which is part of the head body 10, can be formed from, for example, a metal such as stainless steel or a metal based on nickel (Ni), a ceramic material typified by a zirconium oxide ($ZrO_2$) or aluminum oxide ($AL_2O_3$) material, a glass ceramic material, or an oxide such as magnesium oxide (MgO) or lanthanum aluminum oxide ($LaAlO_3$). In this embodiment, the flow path forming substrate 111 is formed from a monocrystalline silicon substrate. In the flow path forming substrate 111, a plurality of pressure generation chambers 112 are formed side by side in a line along the X direction. The plurality of pressure generation chambers 112 are separated by a plurality of partition walls formed by anisotropically etching the flow path forming substrate 111 from its one surface.

A vibration plate 150 is formed on a surface of the flow path forming substrate 111 on the −Z side. In this embodiment, the vibration plate 150 is composed of an elastic film 153 formed from silicon oxide on the same side as the flow path forming substrate 111 and an insulator film 154 formed from zirconium oxide on the elastic film 153. Liquid flow paths including the pressure generation chambers 112 are formed by anisotropically etching the flow path forming substrate 111 from its side, on the +Z side, to which a communication plate 115 is joined. The −Z side of the pressure generation chamber 112 is defined by the vibration plate 150.

A piezoelectric actuator 300 having a first electrode 160, a piezoelectric layer 170, and a second electrode 180 is provided on the vibration plate 150 on the flow path forming substrate 111. In this embodiment, the piezoelectric actuator 300 is a pressure generator that causes a pressure change in ink in the pressure generation chamber 112.

When a voltage is applied between the first electrode 160 and the second electrode 180, the piezoelectric actuator 300 undergoes displacement. That is, when a voltage is applied between the first electrode 160 and the second electrode 180, piezoelectric distortion occurs in the piezoelectric layer 170 sandwiched between the first electrode 160 and the second electrode 180. A portion at which piezoelectric distortion occurs in the piezoelectric layer 170 due to the application of a voltage will be referred to as an active portion. That is, the active portion is a portion at which the piezoelectric layer 170 is sandwiched between the first electrode 160 and the second electrode 180 in the Z direction. In contrast to this, a portion at which piezoelectric distortion does not occur in the piezoelectric layer 170 will be referred to as a non-active portion. In this embodiment, an active portion is formed for each pressure generation chamber 112.

The first electrode 160 is divided for each pressure generation chamber 112. The first electrode 160 forms an individual electrode provided independently for each active portion, which is an essential driving section in the piezoelectric actuator 300.

The piezoelectric layer 170 is continuously provided in the X direction so as to have a predetermined width in the Y direction. The piezoelectric layer 170 is formed from a piezoelectric oxide material having a polarized structure formed on the first electrode 160. For example, the piezoelectric layer 170 is formed from a perovskite-like oxide indicated by the general chemical formula $ABO_3$. Lead-based piezoelectric materials that include lead or non-lead-based piezoelectric materials that do not include lead can be used.

The second electrode 180 is disposed on a surface of the piezoelectric layer 170 in the Z direction, the surface being opposite to the surface on which the first electrode 160 is disposed. The second electrode 180 is a common electrode shared by a plurality of active portions.

An individual wire 191, which is a lead wire, is drawn out of the first electrode 160 of the piezoelectric actuator 300. A common wire (not illustrated), which is a lead wire, is drawn out of the second electrode 180. A flexible cable 120 is coupled to the individual wire 191 and common wire. The flexible cable 120 is a flexible wiring board. In this embodiment, a driving circuit 121, which is a semiconductor element, is mounted on the flexible cable 120.

A protective substrate 130 having substantially the same size as the flow path forming substrate 111 is joined to a surface of the flow path forming substrate 111 on the −Z side. The protective substrate 130 has a holding portion 131, which is a space by which the piezoelectric actuator 300 is protected. The protective substrate 130 has a through-hole 132 formed in the Z direction. The individual wire 191 drawn out of the first electrode 160 of the piezoelectric actuator 300 and the common wire drawn out of the second electrode 180 of the piezoelectric actuator 300 extend so that the ends of these wires are exposed to the interior of this through-hole 132. These ends are electrically coupled to the flexible cable 120 in the through-hole 132.

On a surface of the flow path forming substrate 111 on the +Z direction, the communication plate 115 and a nozzle plate 125 are sequentially laminated.

A nozzle 126 from which ink droplets are discharged is provided in the nozzle plate 125. The nozzle 126 in the nozzle plate 125 communicates with the pressure generation chamber 112 through a nozzle communication path 116 formed in the communication plate 115.

The communication plate 115 has a larger area than the flow path forming substrate 111, and the nozzle plate 125 has a smaller area than the flow path forming substrate 111. Since the pressure generation chamber 112 and the nozzle 126 in the nozzle plate 125 are separated from each other by providing the communication plate 115 as described above, ink in the pressure generation chamber 112 is less likely to be affected by an increase in the viscosity of the ink, the increase being caused when moisture in the ink in the vicinity of the nozzle 126 evaporates. The nozzle plate 125 only needs to cover the opening of the nozzle communication path 116 through which the pressure generation chamber 112 and nozzle 126 communicate with each other. Therefore, the area of the nozzle plate 125 can be made relatively small, enabling the cost to be reduced.

In this embodiment, the communication plate 115 has a first communication plate 151 and a second communication plate 152. The first communication plate 151 and second communication plate 152 are laminated in the Z direction in such a way that the first communication plate 151 is disposed on the −Z side and the second communication plate 152 is disposed on the +Z side.

As the materials of the first communication plate 151 and second communication plate 152, a metal such as stainless steel or a metal based on nickel (Ni) or ceramics based on zirconium (Zr) or the like, for example, can be used. It is preferable to form the first communication plate 151 and second communication plate 152 from the same material, that is, materials having equivalent coefficients of linear expansion. When the same material is used for the first communication plate 151 and second communication plate 152, it is possible to suppress destruction such as a separation or crack caused by a warp due to a difference in coefficients of linear expansion between the first communication plate 151 and the second communication plate 152.

The communication plate 115 has a first manifold portion 171, a second manifold portion 172, and a third manifold portion 173, which communicate with a plurality of pressure generation chambers 112. The first manifold portion 171, second manifold portion 172, third manifold portion 173 formed in the communication plate 115 and a fourth manifold portion 142 formed in a case member 140, which will be described later in detail, constitute a manifold 100 communicating with a plurality of pressure generation chambers 112 in common.

The first manifold portion 171 is formed so as to pass through the first communication plate 151 in the Z direction.

The second manifold portion 172 is formed so as to pass through the second communication plate 152 in the Z direction.

The third manifold portion 173 is formed so as to have an opening in a surface of the second communication plate 152 on the +Z side without passing through the second communication plate 152 in the Z direction. The third manifold portion 173 communicates with an end of the second manifold portion 172 in the −Y direction.

In the communication plate 115, a supply communication path 118 communicating with an end of the pressure generation chamber 112 in the +Y direction is formed independently for each pressure generation chambers 112. The third manifold portion 173 and each pressure generation chamber 112 communicate with each other through the supply communication path 118. That is, the supply communication path 118 is formed next to the third manifold portion 173 in the X direction.

In the communication plate 115, a circulation communication path 119, a first circulation manifold portion 201, a second circulation manifold portion 202, and a third circulation manifold portion 203 are further formed.

The circulation communication path 119 is formed so as to have an opening in a surface of the second communication plate 152 in the +Z direction without passing through the second communication plate 152 in the Z direction. The circulation communication path 119 is provided for each nozzle communication path 116 so that an end of the circulation communication path 119 in the +Y direction communicates with each nozzle communication path 116.

The first circulation manifold portion 201 is formed so as to pass through the second communication plate 152 in the Z direction. The first circulation manifold portion 201, which communicates with a plurality of circulation communication paths 119 in common, continuously extends in the X direction in which the plurality of circulation communication paths 119 are arranged side by side. Another end of the circulation communication path 119 communicates with an end of the first circulation manifold portion 201 in the +Y direction.

The second circulation manifold portion 202 is formed so as to have an opening in a surface of the first communication plate 151 on the +Z side without passing through the first communication plate 151 in the Z direction. That is, the second circulation manifold portion 202 is formed in a joint face between the first communication plate 151 and the second communication plate 152.

The third circulation manifold portion 203 is formed so as to pass through the first communication plate 151 in the Z direction.

The first circulation manifold portion 201, second circulation manifold portion 202, and third circulation manifold portion 203 formed in the communication plate 115 and a fourth circulation manifold portion 143 formed in the case member 140, which will be described later in detail, constitute a circulation manifold 110.

In the head body 10 of this type, ink is supplied from the manifold 100 to the supply communication paths 118, pressure generation chambers 112, and nozzle communication paths 116, and the ink supplied to the nozzle communication paths 116 is further supplied to the circulation manifold 110 through the circulation communication paths 119.

The case member 140 is secured to the −Z sides of the protective substrate 130 and communication plate 115. The case member 140 has substantially the same shape in plan view as the communication plate 115 described above. The case member 140 is joined to both the protective substrate 130 and the communication plate 115. Specifically, the case member 140 has a depression 141 having a depth enough to accommodate the flow path forming substrate 111 and protective substrate 130. This depression 141 has an opening area larger than the area of the protective substrate 130. With the flow path forming substrate 111 and protective substrate 130 accommodated in the depression 141, the opening face of the depression 141 on the +Z side is sealed by the communication plate 115.

The case member 140 has the fourth manifold portion 142 at one end in the Y direction and also has the fourth circulation manifold portion 143 at another end, the fourth manifold portion 142 and fourth circulation manifold portion 143 being open to a face of the case member 140 in the +Z direction.

The first manifold portion 171, second manifold portion 172, third manifold portion 173 formed in the communication plate 115 and the fourth manifold portion 142 formed in the case member 140 constitute the manifold 100, as described above.

The first circulation manifold portion 201, second circulation manifold portion 202, and third circulation manifold portion 203 formed in the communication plate 115 and the fourth circulation manifold 143 formed in the case member 140 constitute the circulation manifold 110, as described above.

The case member 140 also has an inlet 144 communicating with the manifold 100 so that ink is supplied to the manifold 100 and an expelling opening 145 communicating with the circulation manifold 110 so that ink is expelled from the circulation manifold 110.

A compliance substrate 149 is provided on a surface of the communication plate 115 on the +Z side. The compliance substrate 149 seals the openings of the second manifold portion 172 and third manifold portion 173 on the +Z side. In this embodiment, the compliance substrate 149 of this type has a sealing film 491 formed from a flexible thin film and also has a fixed substrate 492 formed from a hard material such as a metal. An area, on the fixed substrate 492, that faces the manifold 100 is an opening 493 formed by completely removing the relevant portion of the fixed substrate 492 in its thickness direction. Therefore, one surface of the manifold 100 is a compliance portion 494, which is a flexible portion sealed only by the sealing film 491 having flexibility. When the compliance portion 494 warps, the compliance substrate 149 eliminates variations in pressure in the manifold 100 and the like.

The compliance substrate 149 may be composed only of the fixed substrate 492. Specifically, part of the fixed substrate 492 is thinned and the thinned part is used as the compliance portion 494 that eliminates variations in pressure in the manifold 100 and the like.

The case member 140 further has a coupling opening 146 communicating with the through-hole 132 in the protective substrate 130, the flexible cable 120 being inserted into the coupling opening 146.

In the head body 10 of this type, ink flows from the first tank 501 through the coupling member 30 and flow path member 20 and is supplied through the inlet 144, after which the manifold 100, pressure generation chamber 112, and circulation manifold 110 are filled with the ink. The ink supplied to the circulation manifold 110 is expelled from the expelling opening 145 through the flow path member 20 and coupling member 30 to the second tank 502. Therefore, the ink is circulated among the first tank 501, second tank 502, and recording head 1.

The head body 10 of this type is integrated with the flow path member 20, and is held by the holding member 40 in a state in which the nozzle 126 in the nozzle plate 125 is exposed toward the +Z side.

Figure 5:
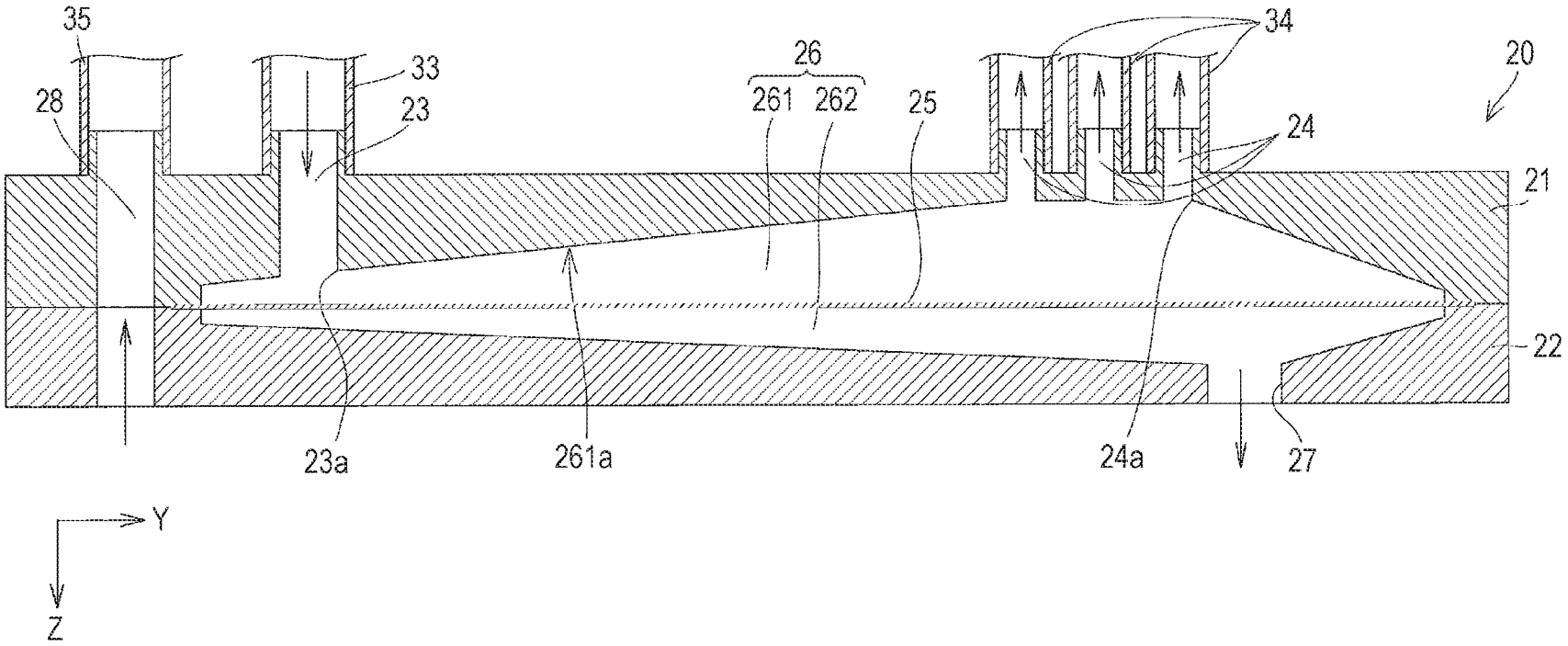
FIG. 5 is a cross-sectional view of a flow path member according to the first embodiment of the present disclosure.
Figure 6:
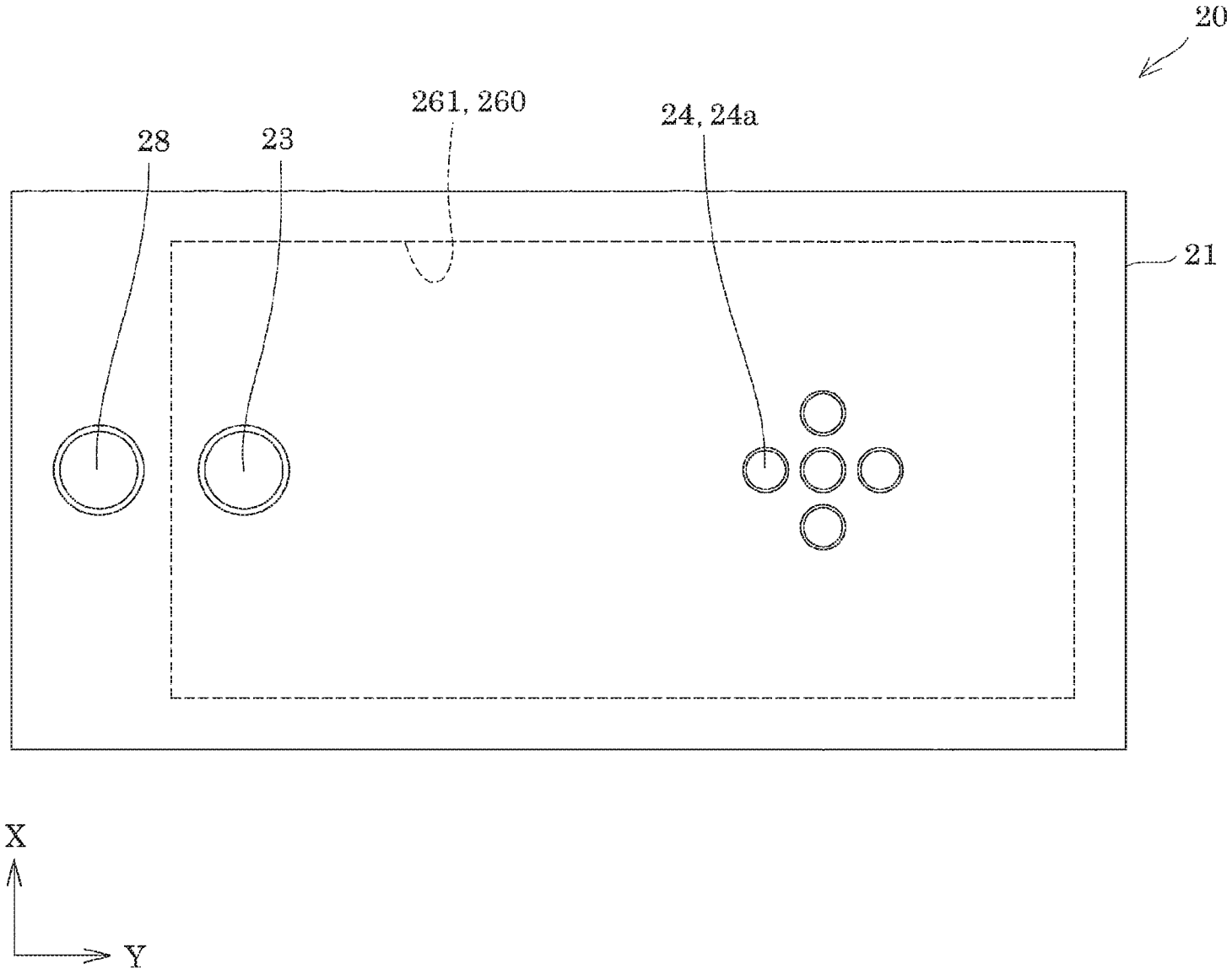
FIG. 6 is a plan view of the flow path member according to the first embodiment of the present disclosure.

The flow path member 20 and coupling member 30 through which ink is supplied to the head body 10 will be described with reference to FIG. 5. FIG. 5 is a cross-sectional view of the flow path member 20 in this embodiment. FIG. 6 is a plan view of the flow path member 20 when viewed from the Z direction.

The coupling member 30, held by the holding member 40, has a first supply path 31 and a first collection path 32 as illustrated in FIG. 3.

The first supply path 31 has a supply opening 31*a* to which the first tank 501 is coupled through a first supply tube 2*a* such as a flexible tube.

The first collection path 32 has a collection opening 32*a* to which the second tank 502 is coupled through a first collection tube 2*b* such as a flexible tube.

That is, the supply opening 31*a* and collection opening 32*a* of the coupling member 30 are provided as external ports coupled to an external mechanism that circulates ink. A plurality of second supply tubes, which will be described later in detail, are coupled to the first collection path 32 so that the first collection path 32 also functions as a sub-tank that temporarily holds ink.

Flow paths of the flow path member 20 are coupled to the first supply path 31 and first collection path 32 of the coupling member 30 described above.

The flow path member 20 has a first flow path member 21 and a second flow path member 22 as illustrated in FIGS. 5 and 6. The first flow path member 21 and second flow path member 22 are laminated in the Z direction so that the first flow path member 21 is on the −Z side and the second flow path member 22 is on the +Z side.

Flow paths are formed in the flow path member 20 of this type. The flow paths formed in the flow path member 20 are a second supply path 23, second collection paths 24 coupled to the first collection path 32, a filter chamber 26 with which the second supply path 23 and second collection paths 24 communicate and in which a filter 25 is provided, and a communication path 27 that communicates with the filter chamber 26 and is coupled to the inlet 144 of the head body 10.

The filter chamber 26 has an upstream chamber 261 disposed upstream of the filter 25 and a downstream chamber 262 disposed downstream of the filter 25. The upstream chamber 261 of the filter chamber 26 has a substantially rectangular shape in plan view when viewed from the Z direction, which is perpendicular to the main surface of the filter 25. The shape of the upstream chamber 261 is its outside shape in plan view when viewed from the Z direction perpendicular to the main surface of the filter 25.

In this embodiment, the upstream chamber 261 has a concave shape formed in the first flow path member 21 so as to be open to a surface of the first flow path member 21 on the +Z side. The downstream chamber 262 has a concave shape formed in the second flow path member 22 so as to be open to a surface of the second flow path member 22 on the −Z side. The filter 25 having an area larger than the areas of the openings of the upstream chamber 261 and downstream chamber 262 is sandwiched between the first flow path member 21 and the second flow path member 22. Thus, the filter chamber 26 is divided into the upstream chamber 261 and downstream chamber 262 by the filter 25. That is, the filter 25 is placed so that the surface direction of the main surface of the filter 25 includes the X direction and Y direction.

Examples of the filter 25 of this type include a sheet-like filter having a plurality of fine holes formed by finely weaving metal or resin fiber and a filter having a plurality of fine through-holes formed in a plate-like member made of a metal, a resin, or the like. Alternatively, a nonwoven cloth may be used as the filter 25. There is no limitation on the material of the filter 25.

The second supply path 23 and second collection paths 24 are open to a surface of the upstream chamber 261 in the filter chamber 26 on the −Z side.

The second supply path 23 is provided so that one end is open to a surface of the first flow path member 21 on the −Z side and another end is open to a ceiling 261*a*, which is a surface of the upstream chamber 261 on the −Z side. In this embodiment, one second flow path 23 is provided for one upstream chamber 261.

The first supply path 31 in the coupling member 30 is coupled to the one end of the second supply path 23, the one end being open to a surface of the first flow path member 21 on the −Z side, through a second supply tube 33, which is, for example, a flexible tube, as illustrated in FIG. 3. That is, ink in the first tank 501 is supplied to the upstream chamber 261 through the first supply tube 2*a*, first supply path 31, second supply tube 33, and second supply path 23.

The second collection path 24 is provided so that one end is open to a surface of the first flow path member 21 on the −Z side and another end is open to the ceiling 261*a*, which is a surface of the upstream chamber 261 on the −Z side. In this embodiment, an opening, to the upstream chamber 261, of the second collection path 24 will be referred to as an outlet 24*a*.

The first collection path 32 is coupled to the one end of the second collection path 24, the one end being open to a surface of the first flow path member 21 on the −Z side, through a second collection tube 34, which is, for example, a flexible tube. That is, the outlet 24*a* is an opening through which the upstream chamber 261 disposed upstream of the filter 25 leads to the collection opening 32*a*. A flow path from the outlet 24*a* to the collection opening 32*a* will be referred to as an outflow path. That is, the outflow path in this embodiment includes the second collection tube 34 and second collection path 24.

A plurality of outlets 24*a* of this type are provided. A plurality of outlets 24*a* means that two or more outlets 24*a* are provided for a single upstream chamber 261. A plurality of outlets 24*a* also means that two or more flow paths each of which couples one upstream chamber 261 and one collection opening 32*a* together are independently provided.

The second collection path 24 and second collection tube 34 in this embodiment are independently provided without being branched at an intermediate point. That is, one outflow path in this embodiment is provided so that the outlet communicating with the upstream chamber 261 and another end communicating with the collection opening 32*a* are in a one-to-one correspondence. When two or more independent flow paths are formed between the upstream chamber 261 and the collection opening 32*a*, outflow paths may be branched at an intermediate point.

In this embodiment, five outlets 24*a* are provided by providing five second collection paths 24. Each of the five second collection paths 24 is independently coupled to the first collection path 32 through the relevant second collection tube 34. That is, each of the plurality of second collection paths 24 and the relevant one of the plurality of second collection tubes 34 are provided so as to communicate with each other between the first collection path 32 and the upstream chamber 261 and not to communicate at other portions.

The ceiling 261*a*, which is the upstream surface of the upstream chamber 261 on the −Z side, the second supply path 23 and second collection paths 24 being open in the upstream surface, is inclined so that the height of the ceiling 261*a* in the Z direction is gradually increased toward a portion at which the outlets 24*a* are open. That is, a plurality of outlets 24*a* (five outlets 24*a* in this embodiment) are disposed at the vertex of the ceiling 261*a* of the upstream chamber 261 on the −Z side. Thus, when bubbles in the upstream chamber 261 move in the −Z direction due to their buoyant force, it is possible to move the bubbles toward the plurality of outlets 24*a* along the inclination of the ceiling 261*a* and to expel the bubbles from the plurality of outlets 24*a* with ease.

Figure 7:
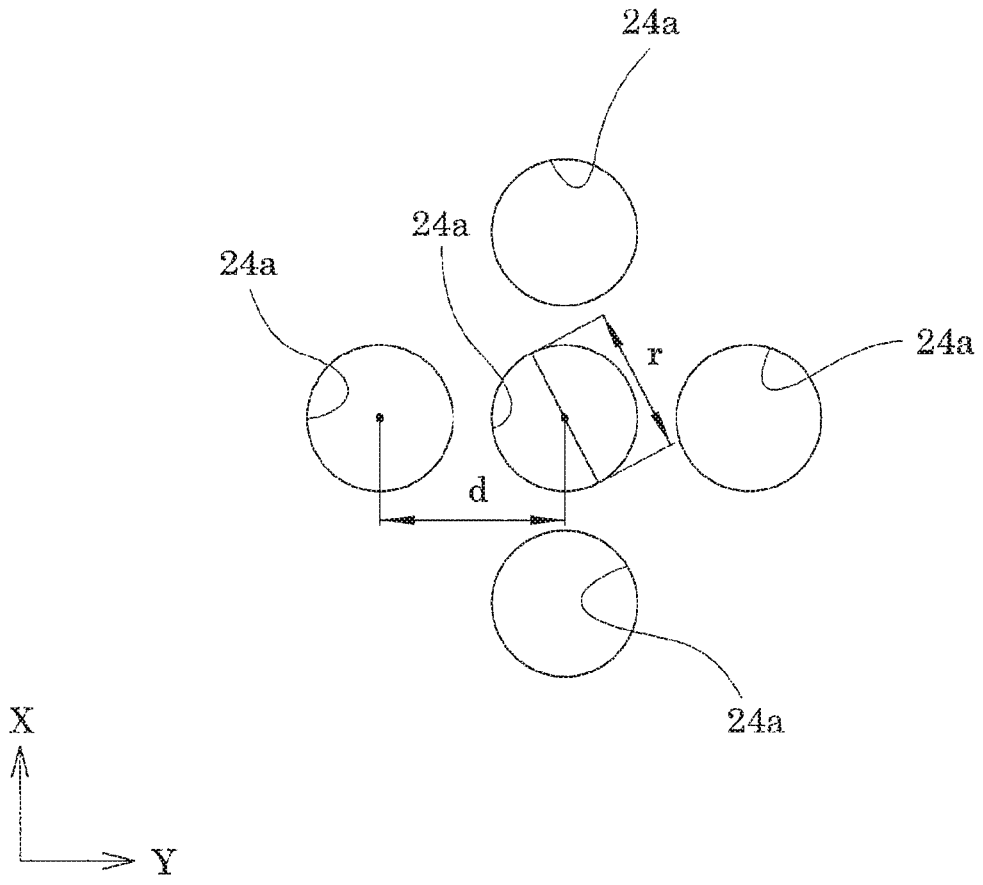
FIG. 7 is a plan view of outlets according to the first embodiment of the present disclosure.

Here, it will be assumed that the diameter of the outlet 24*a* is r and the closest distance among the plurality of outlets 24*a* is d as illustrated in FIG. 7. It is preferable for the plurality of outlets 24*a* to satisfy a relationship in which d is smaller than 2r. FIG. 7 is a plan view of the plurality of outlets 24*a* when viewed from the Z direction.

The diameter r of the outlet 24*a* is measured when the outlet 24*a* is viewed from a direction perpendicular to the main surface of the filter 25, that is, the Z direction, in plan view. When the plurality of outlets 24*a* have different diameters, the diameter r of the outlet 24*a* is the largest among them. When the shape of the outlet 24*a* is not circular (for example, rectangular, polygonal, or elliptical), the diameter r of the outlet 24*a* is the diameter of the circle that is inscribed to the outlet 24*a* and has the minimum area.

The closest distance d among the plurality of outlets 24*a* is the shortest distance of the center distances among the outlets 24*a* when viewed from a direction perpendicular to the main surface of the filter 25, that is, the Z direction, in plan view. When the shape of the outlet 24*a* is not circular (for example, rectangular, polygonal, or elliptical) in plan view when viewed from the Z direction, the center of the outlet 24*a* is the center of the circle that is inscribed to the outlet 24*a* and has the minimum area.

Another point to note is that since each two outlets 24*a* do not come into contact with each other, when the diameters r of the plurality of outlets 24*a* are the same, the closest distance d among the plurality of outlets 24*a* is larger than the diameter r of the outlet 24*a*. That is, a relationship in which d is larger than r is satisfied. That is, even two closest outlets 24*a* are not brought into contact with each other by making the closest distance d larger than the diameter r.

When the closest distance d is smaller than twice the diameter r, the plurality of outlets 24*a* can be spaced close together, making it possible to reduce the occurrence of an area in which a flow of ink is stagnant between adjacent outlets 24*a*. That is, when the closest distance d is smaller than twice the diameter r, a bubble can be made hard to stay between each two outlets 24*a* and can be easily expelled from any one of the two outlets 24*a*. Particularly, when the diameter of a bubble is larger than r, even when the bubble is positioned between two outlets 24*a*, the bubble is made to face any one of the two outlets 24*a* by making the closest distance d smaller than 2r, making the bubble likely to be drawn into the one outlet 24*a*. Of course, even when a bubble with a diameter smaller than r is positioned between two outlets 24*a*, the bubble is drawn into any one of the two outlets 24*a* by a flow of ink, making it possible to restrain the bubble from staying between the two outlets 24*a*.

The second supply path 23 is disposed at other than the vertex of the ceiling 261*a* of the upstream chamber 261. Specifically, the second supply path 23 is positioned at a position close to the filter 25 in the Z direction on the inclined surface of the ceiling 261*a*, so as to have an opening at that position. Even when a bubble captured by the filter 25 moves toward the ceiling 261*a* due to the buoyant force of the bubble, therefore, the bubble can be made hard to enter the second supply path 23.

In this embodiment, one outlet 24*a* and another outlet 24*a* are disposed at different distances from an opening 23*a* formed in the second supply path 23, the opening 23*a* leading to the upstream chamber 261, in plan view when viewed from a direction perpendicular to the main surface of the filter 25 (Z direction in this embodiment). This relationship in which the distance between the opening 23*a* and outlet 24*a* varies only needs to be satisfied between at least two outlets 24*a*. The distances of all outlets 24*a* from the opening 23*a* may not be different. That is, some of a plurality of outlets 24*a* may be at the same distance from the opening 23*a*. When one outlet 24*a* and another outlet 24*a* are disposed at different distances from the opening 23*a* as described above, it is possible to reduce the occurrence of an area in which a flow of ink is stagnant between the one outlet 24*a* and the other outlet 24*a*, making it possible to improve the ease with which bubbles are expelled.

One end of the communication path 27 is an opening formed in the button surface of the downstream chamber 262 in the filter chamber 26 on the +Z side. Another end of the communication path 27 is an opening formed in a surface of the second flow path member 22 on the +Z side. The inlet 144 of the head body 10 is coupled to the communication path 27, which is open to the surface of the second flow path member 22 on the +Z side.

In the flow path member 20 and coupling member 30 of this type, ink in the first tank 501 is supplied toward the supply opening 31*a* of the coupling member 30 through the first supply tube 2*a*, and ink supplied from the supply opening 31*a* of the coupling member 30 is further supplied to the second supply path 23 of the flow path member 20 through the first supply path 31 and second supply tube 33. The ink supplied to the second supply path 23 passes through the filter 25 from the upstream chamber 261 and is supplied to the downstream chamber 262, after which the ink is further supplied from the downstream chamber 262 through the communication path 27 to the inlet 144 of the head body 10.

The ink supplied to the upstream chamber 261 is collected from the outlets 24*a* into the first collection path 32 in the coupling member 30 through the second collection paths 24 and second collection tubes 34 together with dust, bubbles, and other foreign matter captured by the filter 25. The collected ink is further collected from the collection opening 32*a* of the first collection path 32 into the second tank 502 through the first collection tube 2*b*. Thus, it is possible to restrain dust, bubbles, and other foreign matter from remaining attached to the filter 25, making it possible to restrain the effective area of the filter 25 from being reduced due to foreign matter. This makes it possible to stably supply ink to the head body 10 and thereby to suppress variations in the property with which ink droplets are discharged from the head body 10.

Since, in this embodiment, a plurality of outlets 24*a* are provided, variations in pressure, which are caused when bubbles enter the second collection paths 24 and second collection tube 34, are less likely to occur. Specifically, even when a bubble enters any one of the plurality of outlets 24*a*, the flow path resistance of the second collection paths 24 and second collection tubes 34, which correspond to the other outlets 24*a*, does not change, so variations in pressure are less likely to occur. Therefore, pressure in the upstream chamber 261 can be stabilized by reducing variations in pressure that are caused when a bubble passes through the second collection path 24 and second collection tube 34. When only one outlet 24*a* is provided, however, variations occur in the flow path resistance when a bubble enters the second collection path 24 and second collection tube 34. Variations in pressure in the upstream chamber 261 thereby become large. That is, when variations occur in the flow path resistance of the second collection path 24 and second collection tube 34, variations in pressure in the upstream chamber 261 become large and variations in pressure toward the nozzle 126 in the head body 10 become large. Accordingly, variations occur in the property with which ink droplets are discharged. In this embodiment, pressure in the upstream chamber 261 can be stabilized, so it is possible to reduce variations in pressure toward the nozzle 126 in the head body 10 and to suppress the occurrence of variations in the property with which ink droplets are discharged.

When a plurality of outlets 24*a* are provided, the area of the opening of each outlet 24*a* can be made relatively small. That is, when a plurality of outlets 24*a* are provided, even when the area of the opening of each outlet 24*a* is reduced, it is possible to suppress a drop in the entire flow path resistance of the plurality of outflow paths. When the area of the opening of the outlet 24*a* is reduced as described above, the flow path's cross-sectional area crossing the outflow path having the outlet 24*a*, that is, the flow path of the second collection path 24 and second collection tube 34, can be made relatively small. Therefore, the flow rate of ink flowing in the second collection path 24 and second collection tube 34 can be raised, and a drag applied to the bubble in the second collection path 24 and second collection tube 34 can thereby be increased. This makes it possible to improve the ease with which the bubble is expelled without the bubble staying in the second collection path 24 and second collection tube 34. In contrast to this, when the flow path's cross sectional areas of the second collection path 24 and second collection tube 34 is enlarged by, for example, increasing the area of the opening of the outlet 24*a*, the flow rate of ink flowing in the second collection path 24 and second collection tube 34 is lowered. When the flow rate of ink flowing in the second collection path 24 and second collection tube 34 is lowered, a drag applied to the bubble is reduced and the bubble thereby stays in the second collection path 24 and second collection tube 34, lowering the ease with which bubbles are expelled.

In this embodiment, when a plurality of outlets 24*a* are provided, the area of the opening of each outlet 24*a* can be made relatively small as described above. Therefore, when a state is established in which a bubble flows in the second collection path 24 and second collection tube 34 while clogging them, the ease with which the bubble is expelled can be improved. Specifically, when the second collection path 24 and second collection tube 34 are clogged with the bubble, a difference in pressure occurs between the upstream and downstream of the bubble, making it easy for the bubble to move toward the downstream. When the area of the opening of the outlet 24*a* is made relatively small, a bubble clogging the second collection path 24 and second collection tube 34 may have a small size, making it possible to improve the ease with which a small bubble is expelled. In contrast to this, when the opening of the outlet 24*a* has a relatively large area, it is hard for a small bubble to clog the second collection path 24 and second collection tube 34. When a small bubble does not clog the second collection path 24 and second collection tube 34, a difference in pressure does not occur between the upstream and downstream of the bubble, making it hard for the small bubble to move.

The size of a bubble that can be captured by the filter 25 in the upstream chamber 261 is determined by the average hole diameter of the filter 25. When, the average hole diameter of the filter 25 is, for example, 20 μm, bubbles with diameters of 20 μm or more are captured by the filter 25. When the average hole diameter of the filter 25 is 20 μm, it is preferable for the inner diameter of the outlet 24*a*, that is, the inner diameter of the second collection path 24 and the inner diameter of the second collection tube 34, to be 1 mm or less. This makes it possible to raise the flow rate in the second collection path 24 and second collection tube 34 and to improve the ease with which a bubble is expelled by clogging the second collection path 24 and second collection tube 34 with the bubble to generate a difference in pressure between the upstream and downstream of the bubble and thereby to move the bubble. It is also preferable for the inner diameters of the second collection path 24 and second collection tube 34 to be in the range of one to 100 times the average hole diameter of the filter 25.

In this embodiment, the inner diameter of the outlet 24*a* is substantially the same as the inner diameter of the second collection path 24 and the inner diameter of the second collection tube 34. Of course, the second collection path 24 and second collection tube 34 may have different inner diameters. When the second collection path 24 and second collection tube 34 have largely different inner diameters, however, a step is generated between the second collection path 24 and the second collection tube 34 and a bubble is likely to stay at the step. Another problem is that the flow rate is lowered in the flow path having a larger inner diameter and the ease with which bubbles are expelled is thereby lowered. Therefore, it is preferable for the second collection path 24 and second collection tube 34 to have substantially the same inner diameter, and it is also preferable for the inner diameters of the second collection path 24 and second collection tube 34 to be substantially the same as the inner diameter of the outlet 24*a*.

The flow path member 20 in this embodiment further has an expelling path 28 that couples the first collection path 32 and the expelling opening 145 of the head body 10 together. The expelling path 28 in this embodiment is provided so as to pass through the flow path member 20 in the Z direction. The expelling path 28 in the flow path member 20 and the first collection path 32 in the coupling member 30 are coupled together through an expelling tube 35, which is a flexible tube. The expelling path 28 may have a horizontal flow path provided at an intermediate point so as to be along a direction crossing the Z direction such as, for example, the X or Y direction. Of course, the expelling tube 35 may be coupled directly to the expelling opening 145 of the head body 10 without the expelling path 28 being provided in the flow path member 20. The expelling opening 145 of the head body 10 may be coupled directly to the second tank 502 without passing through the first collection path 32. When the second tank 502 and the expelling opening 145 of the head body 10 are directly coupled together, the number of flow paths that couple the recording head 1 and second tank 502 together is increased. Then, it becomes difficult to route these flow paths, resulting in a large size. Another problem is that the number of parts such as pipes increases and the cost is thereby increased. Therefore, it is preferable for the expelling opening 145 of the head body 10 to be coupled to the first collection path 32. This can reduce the number of flow paths that couple the recording head 1 and second tank 502 together and can make it easy to rout the flow paths. Thus, the size can be reduced and the number of parts such as pipes can also be reduced, enabling the cost to be reduced.

As described above, in this embodiment, the expelling opening 145 of the head body 10 and the outlet 24*a* of the flow path member 20 are coupled to the same collection opening 32*a*. Specifically, the communication path 27, a flow path in the head body 10 from the inlet 144 to the expelling opening 145, the expelling path 28, the expelling tube 35, and the first collection path 32 are provided as a flow path that couples the collection opening 32*a* and the downstream chamber 262 disposed downstream of the filter 25 together. In addition, the second collection path 24 and second collection tube 34 included in an outflow path corresponding to the outlet 24*a* are coupled to a flow path that couples the downstream chamber 262 and collection opening 32*a* together. Thus, collection of ink from the upstream chamber 261 and collection of ink in the flow path passing through the interior of the head body 10 from the downstream chamber 262 can be concurrently performed just by collecting ink from a single collection opening 32*a*. This can simplify the mechanism that circulates ink and can thereby reduce the cost.

As described above, the recording head 1 in this embodiment has the supply opening 31*a* toward which ink is supplied as a liquid, the collection opening 32*a* through which the supplied ink is collected, the nozzle 126 that ejects the ink supplied from the supply opening 31*a*, the filter 25 disposed at an intermediate point in a flow path that couples the supply opening 31*a* and nozzle 126 together, and a plurality of outlets 24*a* leading from the upstream chamber 261 disposed upstream of the filter 25 to the collection opening 32*a*.

When a plurality of outlets 24*a* are provided as described above, variations in pressure in the upstream chamber 261 are less likely to occur, the variations being caused when a bubble enters the second collection path 24 and second collection tube 34. Specifically, even when a bubble enters the second collection path 24 and second collection tube 34 from any one of the plurality of outlets 24*a*, no change occur in the flow path resistance of the second collection paths 24 and second collection tubes 34 corresponding to the other outlets 24*a*, so variations in pressure are less likely to occur. Therefore, pressure in the upstream chamber 261 can be stabilized and variations in pressure toward the nozzle 126 in the head body 10 can thereby be reduced by reducing variations in pressure that are caused when a bubble passes through the second collection path 24 and second collection tube 34, making it possible to suppress variations in the property with which ink droplets are discharged.

When a plurality of outlets 24*a* are provided, the area of the opening of each outlet 24*a* can be made relatively small. That is, when a plurality of outlets 24*a* are provided, it is possible to suppress a drop in the entire flow path resistance of a plurality of outflow paths even when the area of the opening of each outlet 24*a* is reduced. When the area of the opening of the outlet 24*a* is made relatively small, the outflow path having the outlet 24*a*, that is, the second collection path 24 and second collection tube 34, can have a relatively small flow path's cross-sectional area crossing the flow path. Therefore, the flow rate of ink flowing in the outflow path can be raised, and a drag applied to the bubble in the outflow path can thereby be increased. Then, the ease with which bubbles are expelled can be improved. In this embodiment, when a plurality of outlets 24*a* are provided, the area of the opening of each outlet 24*a* can be made relatively small as described above. Therefore, when a state is established in which a bubble flows in the second collection path 24 and second collection tube 34 while clogging them, the ease with which the bubble is expelled can be improved. Specifically, when the second collection path 24 and second collection tube 34 are clogged with a bubble, a difference in pressure occurs between the upstream and downstream of the bubble, making it easy for the bubble to move toward the downstream. When the area of the opening of the outlet 24*a* is made relatively small, the size of the bubble clogging the second collection path 24 and second collection tube 34 can be reduced, making it possible to improve the ease with which small bubbles are expelled.

It is preferable for the recording head 1 in this embodiment to satisfy a relationship in which d is smaller than 2r, d being the closest distance among the plurality of outlets 24*a, r* being the diameter of the outlet 24*a*. Then, it possible to reduce the occurrence of an area in which a flow of ink is stagnant between adjacent outlets 24*a*. This makes it possible to improve the ease with which a bubble is expelled between each two outlets 24*a*.

In the recording head 1 in this embodiment, it is preferable for one outlet 24*a* and another outlet 24*a* to be disposed at different distances from the opening 23*a* leading from the upstream chamber 261 disposed upstream of the filter 25 to the supply opening 31*a* in plan view when viewed from the Z direction, which is a direction perpendicular to the main surface of the filter 25. Accordingly, it is possible to reduce the occurrence of an area in which a flow of ink is stagnant between adjacent outlets 24*a*. Therefore, the ease with which a bubble is expelled can be improved between two outlets 24*a*.

In this embodiment, it is preferable for the recording head 1 to further have the communication path 27, a flow path in the head body 10, the expelling path 28, the expelling tube 35, and the first collection path 32 as a flow path that couples the collection opening 32*a* and the downstream chamber 262 disposed downstream of the filter 25 together. It is also preferable for the second collection path 24 and second collection tube 34, included in an outflow path corresponding to the outlet 24*a*, to be coupled to the flow path that couples the downstream chamber 262 and collection opening 32*a* together. Thus, collection of ink from the upstream chamber 261 and collection of ink in the flow path passing through the interior of the head body 10 from the downstream chamber 262 can be concurrently performed just by collecting ink from a single collection opening 32*a*. This can simplify the mechanism that circulates ink and can thereby reduce the cost.

The ink jet recording system, which is the liquid ejecting system in this embodiment, has the ink jet recording head 1, which is a liquid ejecting head, and also has the main tank 500, first tank 501, second tank 502, compressor 503, vacuum pump 504, first liquid feeding pump 505, and second liquid feeding pump 506 as a mechanism that supplies ink as a liquid toward the supply opening 31*a* and collects the supplied ink from the collection opening 32*a* so that the ink is circulated.

When ink is circulated to and from the recording head 1, dust, bubbles, and other foreign matter in the upstream chamber 261 can be expelled to the outside. Therefore, it is possible to restrain the effective area of the filter 25 from being reduced due to foreign matter in the upstream chamber 261. This makes it possible to stably supply ink toward the nozzle 126 and thereby to suppress variations in the property with which ink droplets are discharged.

In this embodiment, the upstream chamber 261 of the filter chamber 26 has been rectangular in plan view when viewed from the Z direction, which is perpendicular to the main surface of the filter 25. However, this is not a particular limitation. The upstream chamber 261 may be circular, elliptical, polygonal, or the like.

In this embodiment, five outlets 24*a* have been placed so that their closest distance d is smaller than twice the diameter r of the outlet 24*a*. However, this is not a particular limitation.

Figure 8:
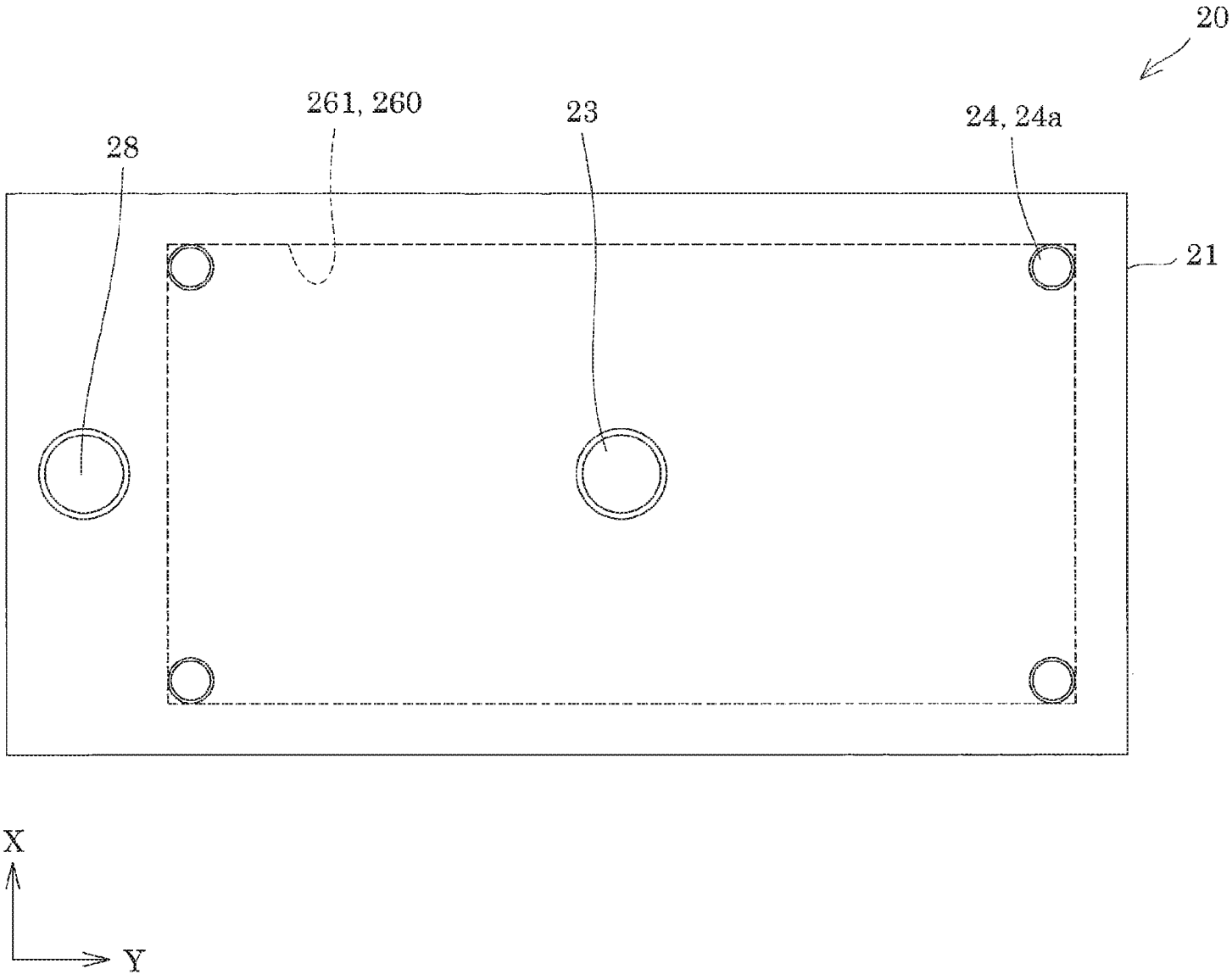
FIG. 8 is a plan view of a variation for the outlets according to the first embodiment of the present disclosure.

For example, when the upstream chamber 261 disposed upstream of the filter chamber 26 is rectangular in plan view when viewed from the Z direction, which is perpendicular to the main surface of the filter 25, the outlet 24*a* may be disposed at each of the four corners of the upstream chamber 261 as illustrated in FIG. 8. Thus, even when the recording head 1 is disposed so that any one of the four corners is placed on the upper side in the vertical direction, bubbles in the upstream chamber 261 can still be expelled from each outlet 24*a*. Therefore, the orientation of the recording head 1 during its use, that is, the direction in which ink droplets are discharged from the nozzle 126, is not limited to the downward vertical direction, so the versatility of the recording head 1 can be enhanced. Of course, when the upstream chamber 261 is polygonal in plan view when viewed from the Z direction, the outlet 24*a* can be disposed at the position corresponding to each corner. In the example in FIG. 8, one outlet 24*a* is disposed at the position corresponding to each corner of the rectangular upstream chamber 261, this is not a limitation on the number of outlets 24*a*. Two or more outlets 24*a* may be disposed at the position corresponding to each corner of the upstream chamber 261.

Figure 9:
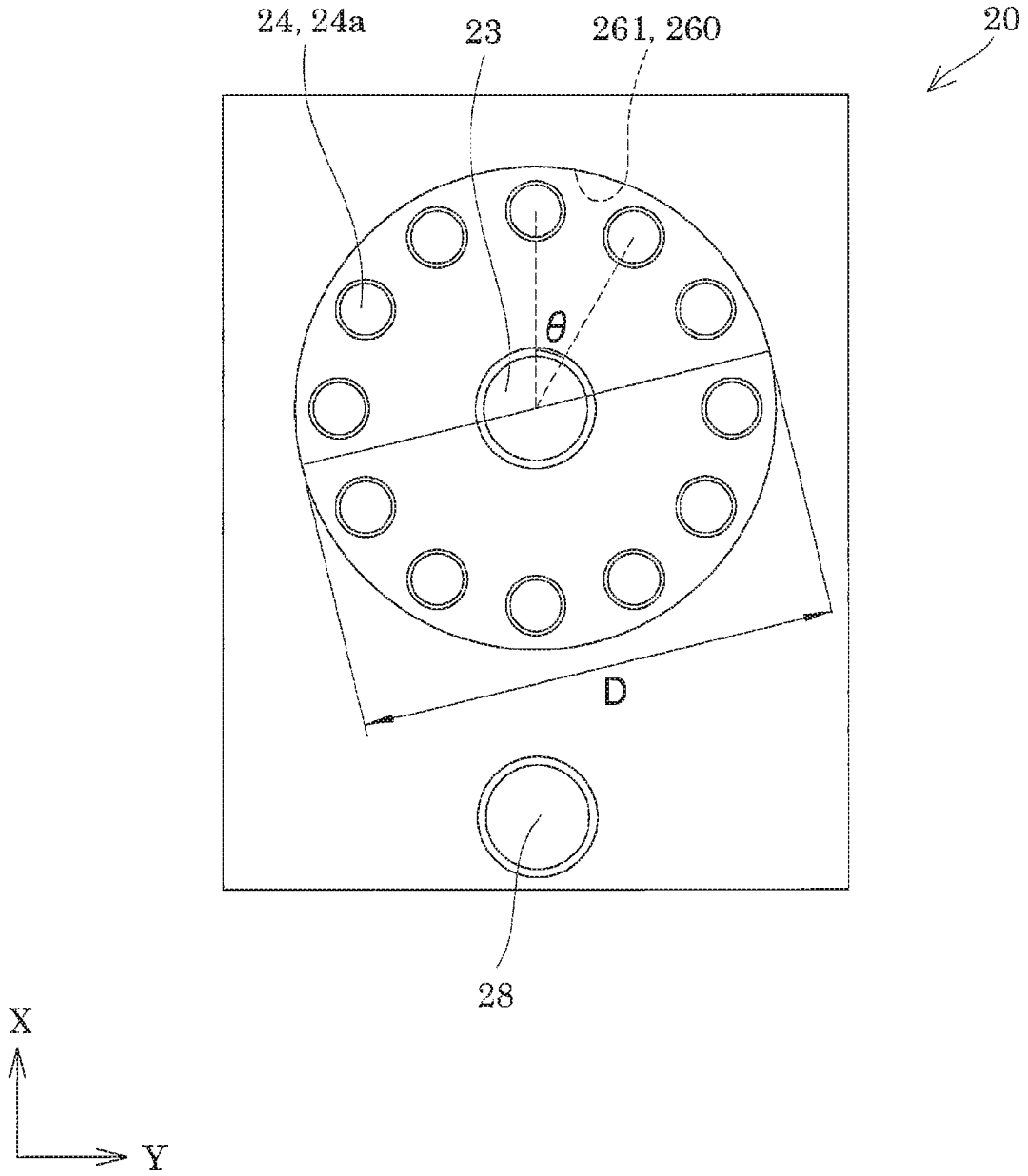
FIG. 9 is a plan view of another variation for the outlet according to the first embodiment of the present disclosure.

It is preferable for one outlet 24*a* and another outlet 24*a* to be separated from each other by a distance of at least sin 15 degrees times the diameter D of the upstream chamber 261, that is, at least 0.259 times the diameter D of the upstream chamber 261, in plan view when viewed from the Z direction, which is perpendicular to the main surface of the filter 25. In this case, when, for example, the upstream chamber 261 is circular in plan view when viewed from the Z direction and outlets 24*a* are mutually adjacent along the outer circumferential direction of the diameter D of the upstream chamber 261 as illustrated in FIG. 9, the outlets 24*a* are separated to the extent that their central angle θ is 30 degrees or more. The distance between one outlet 24*a* and another outlet 24*a* is the center distance between the two outlets 24*a*.

It is more preferable for one outlet 24*a* and another outlet 24*a* to be separated from each other by a distance of at least sin 30 degrees times the diameter D of the upstream chamber 261, that is, at least 0.5 times the diameter D of the upstream chamber 261, in plan view when viewed from the Z direction, which is perpendicular to the main surface of the filter 25. In this case, when, for example, outlets 24*a* are mutually adjacent along the outer circumferential direction of the diameter D of the upstream chamber 261, the outlets 24*a* are separated to the extent that their central angle θ is 60 degrees or more.

Figure 10:
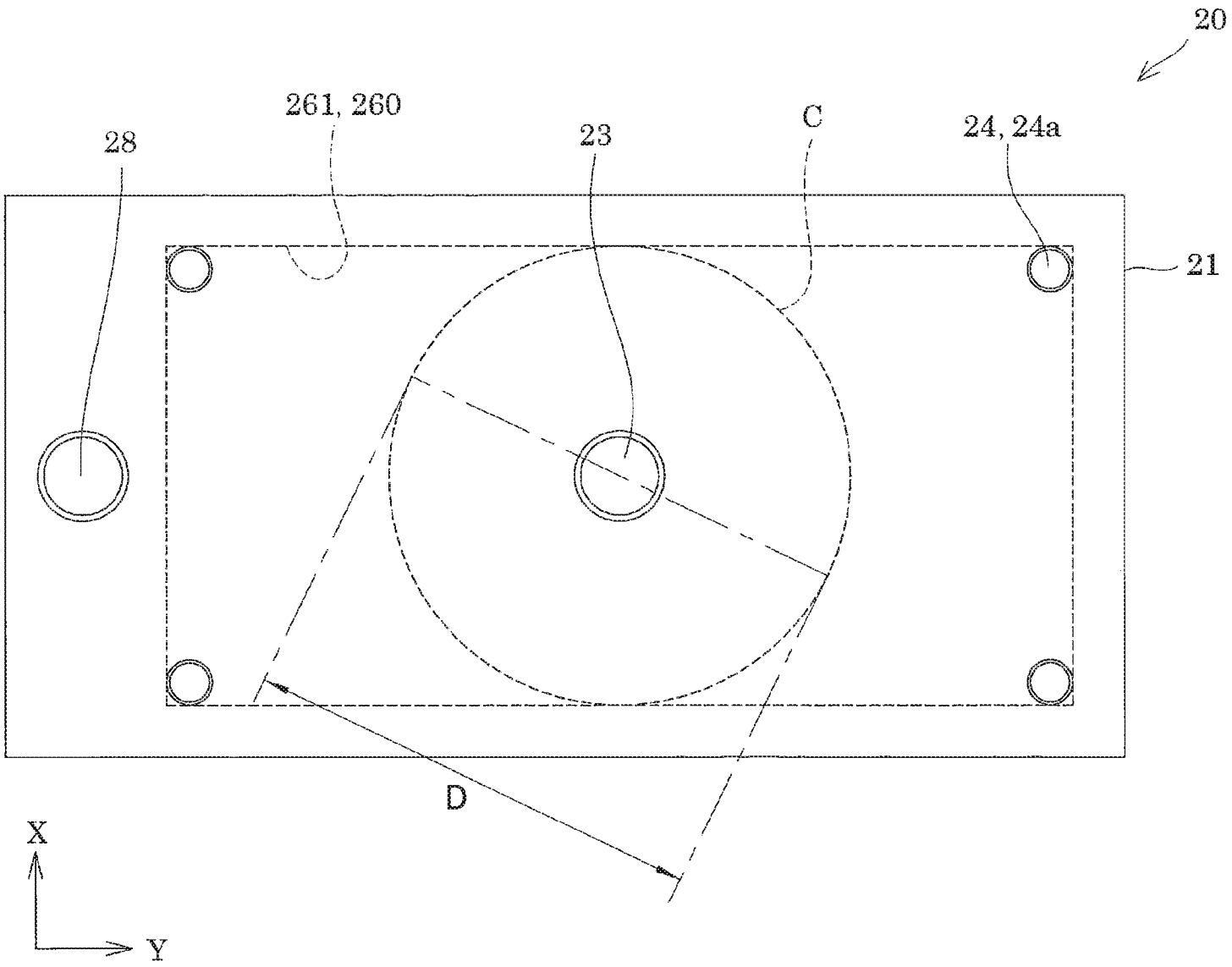
FIG. 10 is a plan view to explain the diameter of an upstream chamber according to the first embodiment of the present disclosure.

The diameter D of the upstream chamber 261 is measured when the upstream chamber 261 is viewed from the Z direction, which is perpendicular to the main surface of the filter 25, in plan view. The upstream chamber 261 may be, for example, rectangular, polygonal, or elliptical in plan view when viewed from the Z direction. In this case, the diameter D of the upstream chamber 261 is the diameter of the circle that is inscribed to the upstream chamber 261 and has the maximum area. When the upstream chamber 261, is for example, rectangular in plan view when viewed from the Z direction as illustrated in FIG. 10, the diameter D of the virtual circle C inscribed to the upstream chamber 261 is the diameter D of the upstream chamber 261.

When a plurality of outlets 24*a* are disposed at mutually distant positions, there is no need to bring bubbles distributed in the upstream chamber 261 in one place before collecting the bubbles. Bubbles can be expelled from the outlets 24*a* disposed at mutually distant positions, so the ease with which bubbles are expelled can be improved.

Among a plurality of outlets 24*a*, one outlet 24*a* and another outlet 24*a* can have different inner diameters. To vary the inner diameters of one outlet 24*a* and another outlet 24*a*, it suffices for only one outlet 24*a* and another outlet 24*a* among a plurality of outlets 24*a* to have different inner diameters, and the remaining outlets 24*a* may have the same inner diameters. The flow path resistances of the outflow paths corresponding to the outlets 24*a* having different inner diameters can be varied by changing the inner diameters of outlets 24*a* as described above. Alternatively, the flow path resistances of the outflow paths can be made the same. With the outflow paths having different flow path resistances, a flow of ink can be formed in the upstream chamber 261 so that ink flows toward the outlet 24*a* corresponding to the outflow path having a small flow path resistance. Therefore, the ease with which bubbles are expelled can be improved by controlling a flow of bubbles. With the outflow paths having the same flow path resistance, bubbles can be evenly expelled.

The inner diameter, referred to here, of the outlet 24*a* is measured when the outlet 24*a* is viewed from the Z direction, which is perpendicular to the main surface of the filter 25, in plan view. When the shape of the outlet 24*a* is not circular (for example, rectangular, polygonal, or elliptical) in plan view in the Z direction, the inner diameter of the outlet 24*a* is the diameter of the circle that is inscribed to the outlet 24*a* and has the minimum area.

Among a plurality of outlets 24*a*, one outlet 24*a* and another outlet 24*a* can be provided so that their corresponding outflow paths have different lengths. Since the outflow path in this embodiment includes the second collection path 24 and second collection tube 34, two outflow paths can have different lengths by, for example, making a difference in length between their second collection tubes 34. Of course, two outflow paths can have different lengths by making a difference in length between their second collection paths 24. When one outflow path and another outflow path are provided so that their lengths are different, it suffices for only one outflow path and another outflow to have different lengths, and the remaining outflow paths may have the same length. When the lengths of outflow paths are varied in this way, the flow path resistances of outflow paths can be varied by changing their lengths as described above. Alternatively, the flow path resistances of outflow paths can be made the same. Particularly, in this embodiment, the outflow path has a relatively small cross-sectional area in the flow path. Therefore, even when an amount by which the length of the outflow path is adjusted is small, its flow path resistance can be changed by a relatively large amount. With the outflow paths having different flow path resistances, a flow of ink can be formed in the upstream chamber 261 so that ink flows toward the outlet 24*a* corresponding to the outflow path having a small flow path resistance. Therefore, the ease with which bubbles are expelled can be improved by controlling a flow of bubbles. With the outflow paths having the same flow path resistance, bubbles can be evenly expelled.

That is, it is preferable for an outflow path communicating with one outlet 24*a* and an outflow path communicating with another outlet 24*a* to be provided so that they have different flow path resistances. Thus, a flow of ink can be formed in the upstream chamber 261 so that ink flows toward the outlet 24*a* corresponding to the outflow path having a small flow path resistance. Therefore, the ease with which bubbles are expelled can be improved by controlling a flow of bubbles.

Second Embodiment

Figure 11:
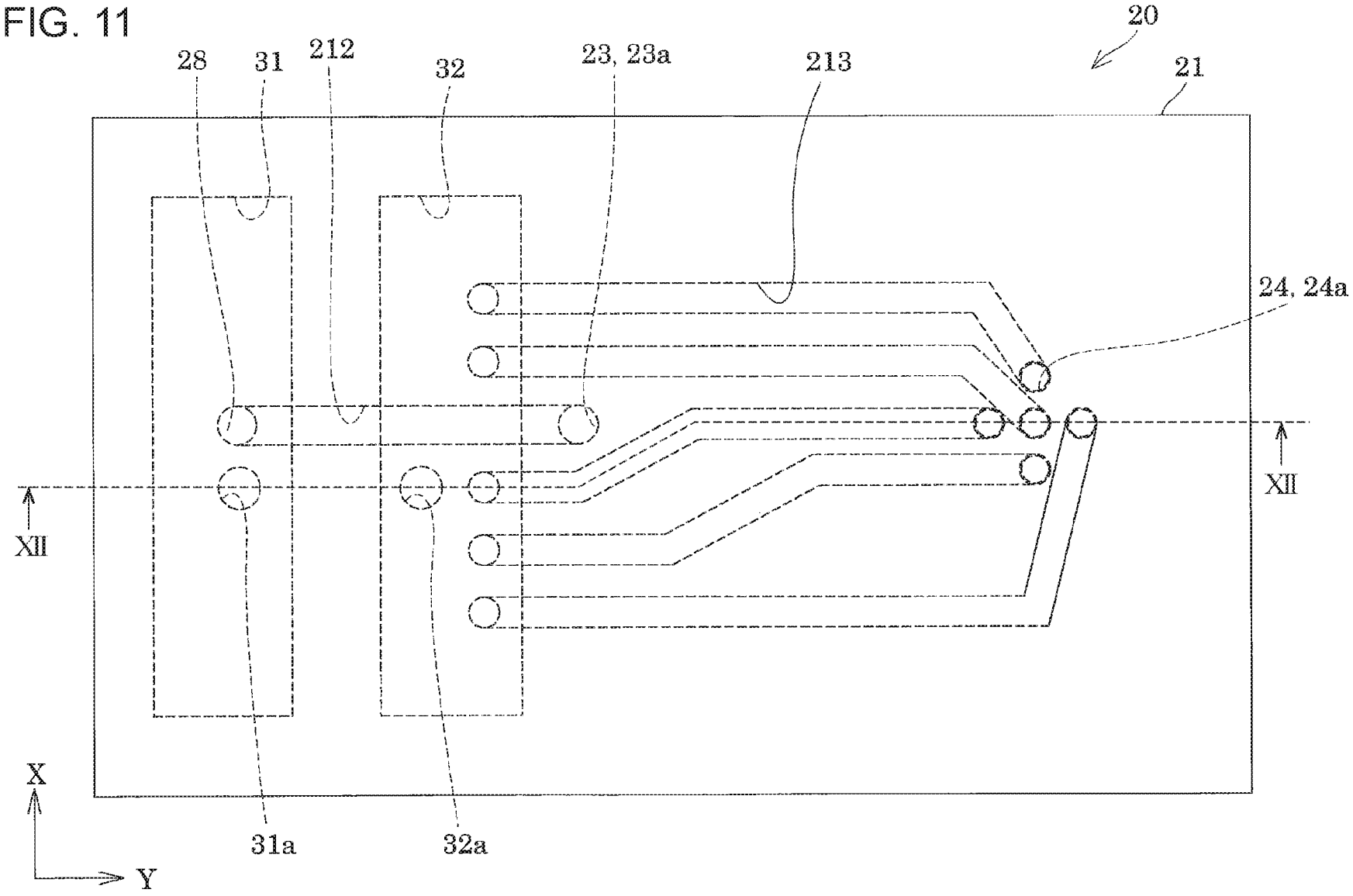
FIG. 11 is a plan view of a flow path member according to a second embodiment of the present disclosure.
Figure 12:
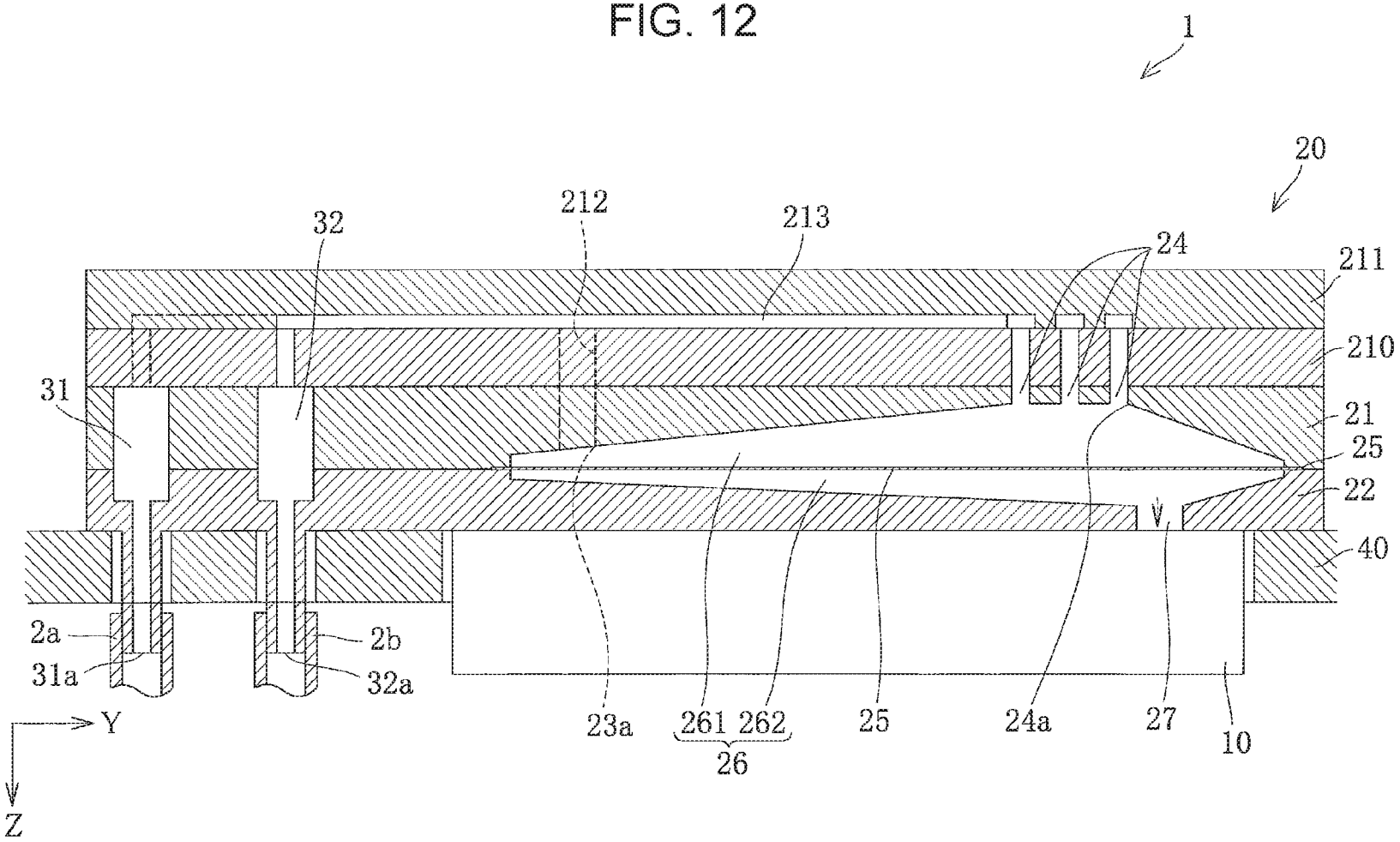
FIG. 12 is a cross-sectional view of the flow path member according to the second embodiment of the present disclosure.

FIG. 11 is a plan view of a flow path member in an ink jet recording head, which is an example of a liquid ejecting head according to a second embodiment of the present disclosure. FIG. 12 is a cross-sectional view taken along line XII-XII in FIG. 11. Members that are similar to those in the first embodiment described above will be given the same reference characters and repeated descriptions will be omitted.

The flow path member 20 has the first flow path member 21, the second flow path member 22, a third flow path member 210, and a fourth flow path member 211 as illustrated in FIG. 12.

The first flow path member 21 and second flow path member 22 include the second supply path 23, second collection paths 24, each of which has the outlet 24*a*, the filter chamber 26 having the upstream chamber 261 and downstream chamber 262, flow paths including the communication path 27, and the filter 25 provided in the filter chamber 26, as in the first embodiment described above.

The first flow path member 21 and second flow path member 22 also include the first supply path 31 having the supply opening 31*a* and the first collection path 32 having the collection opening 32*a*. That is, in the first flow path member 21 and second flow path member 22, the flow path member 20 and coupling member 30 in the first embodiment described above are integrally formed.

The third flow path member 210 is joined to a surface of the first flow path member 21 on the −Z side. The fourth flow path member 211 is joined to a surface of the third flow path member 210 on the −Z side.

The third flow path member 210 and fourth flow path member 211 include a third supply path 212 through which the first supply path 31 and second supply path 23 communicate with each other, and also include third collection paths 213 through which first collection path 32 and second collection paths 24 communicate with each other. That is, in this embodiment, the third flow path member 210 and fourth flow path member 211, which form a laminated member in which the third supply path 212 and third collection paths 213 are formed, are provided instead of the second supply tube 33 and second collection tube 34 in the first embodiment described above.

The third collection paths 213 are provided independently of the second collection paths 24. In this embodiment, five second collection paths 24 are provided, so five third collection paths 213 are provided to match the number of second collection paths 24. On the boundary between the third flow path member 210 and the fourth flow path member 211, the third collection paths 213 are routed along an in-plane direction including the X and Y directions. That is, each third collection path 213 has a horizontal flow path provided on the boundary between the third flow path member 210 and the fourth flow path member 211. Thus, a plurality of third collection paths 213 can be routed in an in-plane direction including the X and Y directions.

Similarly, on the boundary between the third flow path member 210 and the fourth flow path member 211, part of the third supply path 212 is also routed along an in-plane direction including the X and Y directions.

Therefore, an outflow path, in this embodiment, communicating with the outlet 24*a* includes the second collection path 24 and third collection path 213.

Since, as an outflow path communicating with the outlet 24*a*, the third collection path 213 is provided in the laminated member formed from the third flow path member 210 and fourth flow path member 211 as described above, a flow path that has a small cross-sectional area and a high flow path resistance can be easily formed in a relative narrow space, unlike the second collection tube 34 formed from a flexible tube or the like. Therefore, the flow rate of ink flowing in the third collection path 213 can be raised, making it possible to improve the ease with which bubbles are expelled.

When a horizontal flow path is provided at an intermediate point in the third collection path 213, it is possible to restrain bubbles from resisting a flow of bubbles due to their buoyant force. This can further improve the ease with which bubbles are expelled.

Other Embodiments

So far, embodiments of the present disclosure have been described. However, the basic structure in the present disclosure is not limited to the structures described above.

For example, in the embodiments described above, the recording head 1 has had the head body 10, flow path member 20, and coupling member 30, as well as the holding member 40 that hold them. However, this is not a particular limitation. For example, the holding member 40 may be the carriage 3 in the ink jet recording apparatus I. That is, the recording head 1 may be composed of the head body 10, flow path member 20, and coupling member 30. In the first embodiment described above, the flow path member 20 and coupling member 30 have been separated. However, the coupling member 30 and flow path member 20 may be integrally formed as in the second embodiment described above. In the first embodiment described above, the collection opening 32*a* has been an opening at one end of the first collection path 32. However, this is not a particular limitation. An opening of the second collection tube 34 at one end may be used as a collection opening, without providing the coupling member 30. Similarly, as for the supply opening 31*a*, an opening of the second supply tube 33 at one end may be used as a supply opening, without providing the coupling member 30. Alternatively, an opening of the second supply path 23, the opening being formed in a surface of the flow path member 20 on the −Z side, may be used as a supply opening.

In the first embodiment described above, the flow path member 20 has been a laminated member formed from the first flow path member 21 and second flow path member 22. However, this is not a particular limitation. The flow path member 20 may be a laminated member composed of three or more members. The direction in which the members constituting the flow path member 20 are laminated is not limited to the Z direction. The constituent members may be laminated in a direction crossing the Z direction.

In the embodiments described above, the outflow path corresponding to the outlet 24*a* has been coupled to a flow path that couples the downstream chamber 262 and collection opening 32*a* together. However, this is not a particular limitation. The outflow path corresponding to the outlet 24*a* and the flow path coupled to the downstream chamber 262 may be separately coupled to tanks.

In the embodiments described above, ink in the head body 10 has been circulated to and from the first tank 501 and second tank 502. However, this is not a particular limitation. As long as ink in the upstream chamber 261 disposed upstream of the filter 25 is circulated to and from a tank, ink in the head body 10 may not be circulated to and from a tank.

In the embodiments described above, the ink jet recording apparatus I has been exemplified in which the recording head 1 is mounted on the carriage 3 and is moved in the Y direction, which is the main scanning direction. However, this is not a particular limitation. The present disclosure can also be applied to, for example, a so-called line ink jet recording apparatus in which, with the recording head 1 fixed to the main body 4, printing is performed just by moving a recording sheet S in the X direction, which is the sub-scanning direction.

What is claimed is:

1. A liquid ejecting head comprising:
- a supply opening toward which a liquid is supplied,
- a collection opening through which the liquid supplied from the supply opening is collected,
- a nozzle that ejects the liquid supplied from the supply opening,
- a filter disposed at an intermediate point in a flow path that couples the supply opening and the nozzle together,
- an inlet leading from the supply opening to an upstream chamber disposed upstream of the filter,
- first outlet leading from the upstream chamber to the collection opening, and
- a second outlet leading from an upstream chamber disposed upstream of the filter to the collection opening, wherein
- a distance between the first outlet and the second outlet is smaller than a distance between the inlet and the first outlet.

2. The liquid ejecting head according to claim 1, wherein d is smaller than 2r, d being the closest distance among the first outlet and the second outlet, r being a diameter of the first outlet.

3. The liquid ejecting head according to claim 1, wherein the first outlet and the second outlet are separated by a distance of at least sin 15 degrees times a diameter D of the upstream chamber disposed upstream of the filter in plan view when viewed from a direction perpendicular to a main surface of the filter.

4. The liquid ejecting head according to claim 1, wherein the first outlet and the second outlet are disposed at different distances from an opening leading from the upstream chamber disposed upstream of the filter to the supply opening in plan view when viewed from a direction perpendicular to a main surface of the filter.

5. The liquid ejecting head according to claim 1, wherein the first outlet and the second outlet have different inner diameters.

6. The liquid ejecting head according to claim 1, wherein an outflow path communicating with the first outlet and another outflow path communicating with the second outlet have different lengths.

7. The liquid ejecting head according to claim 1, wherein an outflow path communicating with the outlet and another outflow path communicating with the second outlet have different flow path resistances.

8. The liquid ejecting head according to claim 1, further comprising a flow path that couples the collection opening and a downstream chamber disposed downstream of the filter together, wherein an outflow path corresponding to the first outlet is coupled to the flow path that couples the collection opening and the downstream chamber together.

9. A liquid ejecting system having the liquid ejecting head according to claim 1 and a mechanism that supplies a liquid toward the supply opening and collects the liquid from the collection opening so that the liquid is circulated.

10. The liquid ejecting head according to claim 1, wherein the distance between the first outlet and the second outlet is smaller than a distance between the inlet and the second outlet.

11. A liquid ejecting head that has a supply opening toward which a liquid is supplied, a collection opening through which the liquid supplied from the supply opening is collected, a nozzle that ejects the liquid supplied from the supply opening, and a filter disposed at an intermediate point in a flow path that couples the supply opening and the nozzle together, the head comprising:

a plurality of outlets leading from an upstream chamber disposed upstream of the filter to the collection opening, wherein one outlet and another outlet are separated by a distance of at least sin 15 degrees times a diameter D of the upstream chamber disposed upstream of the filter in plan view when viewed from a direction perpendicular to a main surface of the filter.

12. The liquid ejecting head according to claim 11, wherein d is smaller than 2r, d being the closest distance between the one outlet, r being a diameter of the one outlet.

13. The liquid ejecting head according to claim 11, wherein one outlet and another outlet are disposed at different distances from an opening leading from the upstream chamber disposed upstream of the filter to the supply opening in plan view when viewed from a direction perpendicular to a main surface of the filter.

14. The liquid ejecting head according to claim 11, wherein one outlet and another outlet have different inner diameters.

15. The liquid ejecting head according to claim 11, wherein an outflow path communicating with one outlet and another outflow path communicating with another outlet have different lengths.

16. The liquid ejecting head according to claim 11, wherein an outflow path communicating with one outlet and another outflow path communicating with another outlet have different flow path resistances.

17. The liquid ejecting head according to claim 11, further comprising a flow path that couples the collection opening and a downstream chamber disposed downstream of the filter together, wherein an outflow path corresponding to the outlet is coupled to the flow path that couples the collection opening and the downstream chamber together.

18. A liquid ejecting system having the liquid ejecting head according to claim 11 and a mechanism that supplies a liquid toward the supply opening and collects the liquid from the collection opening so that the liquid is circulated.

* * * * *